US006209168B1

(12) United States Patent
Brickner et al.

(10) Patent No.: US 6,209,168 B1
(45) Date of Patent: Apr. 3, 2001

(54) COMBINATION BRUSHROLL AND NOZZLE INLET CONTROL MECHANISM

(75) Inventors: David M. Brickner, Willoughby; John S. Murphy, Brookpark; Michael F. Wright, Stow, all of OH (US); Kyoshi Yokote, Kasiwa (JP)

(73) Assignee: Royal Appliance Mfg. Co., Cleveland, OH (US)

( * ) Notice: Subject to any disclaimer, the term of this patent is extended or adjusted under 35 U.S.C. 154(b) by 0 days.

(21) Appl. No.: 09/453,596

(22) Filed: Nov. 29, 1999

Related U.S. Application Data

(60) Provisional application No. 60/110,275, filed on Nov. 30, 1998.

(51) Int. Cl.[7] ..... A47L 5/32

(52) U.S. Cl. ..... 15/332; 15/334; 15/347; 15/390

(58) Field of Search ..... 15/331, 332, 334, 15/390, 347

(56) References Cited

U.S. PATENT DOCUMENTS

| | | | | |
|---|---|---|---|---|
| 1,829,582 | | 10/1931 | Carson . | |
| 2,250,282 | | 7/1941 | Swann . | |
| 2,348,861 | * | 5/1944 | Smellie | 15/331 X |
| 2,375,331 | * | 5/1945 | Taylor | 15/332 X |
| 3,460,188 | | 8/1969 | Boyd . | |
| 3,482,276 | | 12/1969 | Fillery . | |
| 3,588,945 | * | 6/1971 | Krier et al. | 15/332 |
| 3,618,158 | | 11/1971 | Wörwag . | |
| 4,446,594 | | 5/1984 | Watanabe et al. . | |
| 4,446,595 | | 5/1984 | Nakada et al. . | |
| 4,637,092 | | 1/1987 | Hayashi et al. . | |
| 4,748,714 | | 6/1988 | Tschudy . | |
| 5,247,720 | * | 9/1993 | Sovis et al. | 15/334 |
| 5,331,716 | | 7/1994 | Hemmann et al. . | |
| 5,388,302 | | 2/1995 | Sundaram et al. . | |
| 5,500,979 | | 3/1996 | Wörwag . | |
| 5,617,611 | * | 4/1997 | Worwag | 15/331 |
| 5,732,439 | * | 3/1998 | Cipolla | 15/334 |
| 5,765,258 | | 6/1998 | Melito et al. . | |
| 5,768,746 | | 6/1998 | Kamatani et al. . | |

FOREIGN PATENT DOCUMENTS

| | | |
|---|---|---|
| 237140 | 1/1962 | (AU) . |

* cited by examiner

*Primary Examiner*—Chris K. Moore
(74) *Attorney, Agent, or Firm*—Fay, Sharpe, Fagan, Minnich & McKee, LLP

(57) ABSTRACT

A vacuum cleaner including a nozzle base comprising a primary suction opening and a suction source. A dust cup assembly is releasably secured to the nozzle base. The dust cup assembly comprises a first inlet and a door positioned adjacent the inlet to selectively open and close the inlet. A rotatable brushroll assembly is positioned adjacent the primary suction opening. A three position control assembly is located on the nozzle base. The control assembly comprises a selector switch and a slide bar. Movement of the selector switch to first and second positions moves the slide bar out of engagement with a finger extending from the door allowing the door to open due to suction air. Movement of the selector switch to a third position moves the slide bar into engagement with the finger to prevent the door from opening due to suction air. The control assembly further comprises a guide arm assembly with a pair of walls forming an opening which selectively receives a first pulley belt, which moves the first pulley belt between alignment with the full-size pulley and an idler pulley. A second pulley belt engages a reduction pulley and a shaft of the brushroll.

25 Claims, 7 Drawing Sheets

FIG. 8A
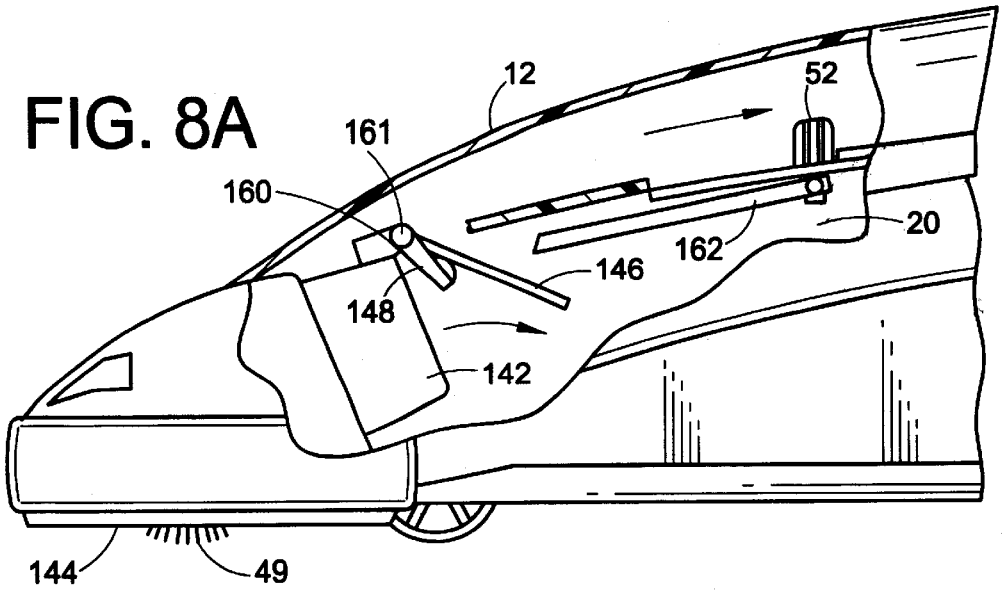
FIG. 8B
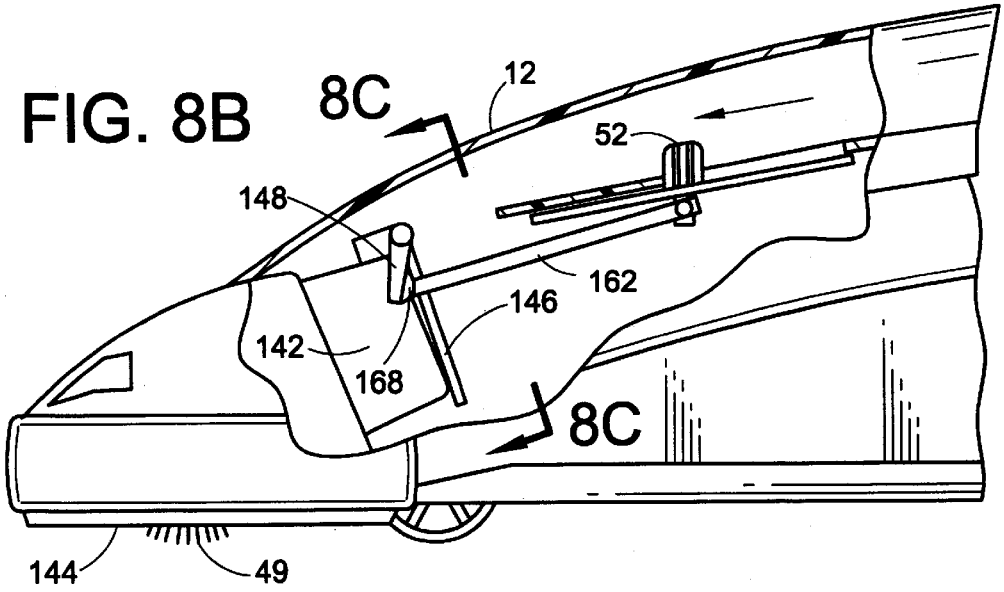
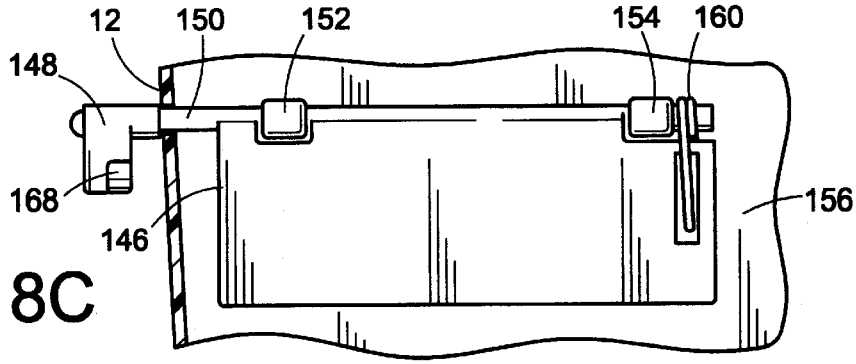
FIG. 8C

COMBINATION BRUSHROLL AND NOZZLE INLET CONTROL MECHANISM

This application claims priority from Provisional Application Serial No. 60/110,275 filed Nov. 30, 1998.

BACKGROUND OF THE INVENTION

The present invention relates to vacuum cleaners. More particularly, the present invention relates to an easily used and easily stored lightweight upright vacuum cleaner for suctioning dirt and debris from carpets, floors and above-floor surfaces.

Upright vacuum cleaners are continually being improved and enhanced with larger, more powerful motors and with an assortment of cleaning accessories and attachments. As upright cleaners are enhanced in this manner, they correspondingly increase in size and weight. The height and the footprint of the nozzle base portion of the cleaner have become larger to accommodate the more powerful motors and, perhaps, some accessories. These enhanced upright cleaners are too heavy and occupy too much storage space to be owned by people dwelling in small apartments, trailers, dormitories, and similar locations with limited storage area. Their size also makes cleaning under beds and other furniture difficult. The handle of many such cleaners is connected to the top of the nozzle base, which undesirably increases the overall height of the nozzle base when the handle is reclined for cleaning under beds and the like. Often, the location of the filter bag and the design of the hinge interconnecting the handle portion to the nozzle base portion prevents the handle from being pivoted downward sufficiently far to approach the surface being cleaned as is required for cleaning under furniture. Furthermore, known upright cleaners are too heavy and do not provide an effective means for hanging storage. Rather, they must be stored on the floor of a closet or in the corner of a room.

Upright vacuum cleaners generally utilize large filter bags to capture the dirt and dust liberated from the subjacent surface being cleaned. These bags are either housed in or connected to the upper handle portion of the cleaner. When full, these bags must be disconnected from the cleaner, disposed of, and replaced. The operator of the cleaner must purchase replacement bags regularly. Furthermore, the bag changing operation is time consuming, and some people object to utilizing disposable filter bags. In addition to the space occupied by the filter bag and its cloth or plastic housing, as these bags fill with dirt, the upper portion of the cleaner becomes quite heavy making the vacuum cleaner unbalanced.

Another drawback associated with known upright vacuum cleaners is their lack of an easy to use and effective power cord storage mechanism. Some upright cleaners utilize a mechanism that retracts the power cord into the upper handle portion of the cleaner. Others utilize a pair of spaced hooks connected to the handle around which the cord is wound. The provision of a retractable cord adds complexity, weight, and expense to the vacuum cleaner. The spaced hooks are inconvenient, require the operator to bend over each time the cord is wound around or unwound from the hooks, and do not provide a mechanism for quick and secure short-term storage of the cord. The cord must either be loosely draped over the handle where it is insecure and becomes tangled, or the cord must be completely wrapped around the hooks each time one desires to store the cord.

While certain upright cleaners have been designed in an effort to overcome some of the foregoing deficiencies, they have not been successful. One known cleaner utilizes a dust cup in the nozzle base portion to collect dirt and dust in place of the filter bag. However, the dust cup is difficult to remove from the cleaner. In order to empty the contents of the dust cup, the operator must grasp the filter assembly with two hands. This can result in the spillage of the contents of the dust cup when it becomes separated from the filter assembly.

It would also be desirable to have an upright vacuum cleaner in which the rotation of the brushroll can be stopped for bare floor cleaning or for above-floor cleaning and in which communication between the floor nozzle of the vacuum cleaner and the removable dust container can be blocked when the vacuum cleaner is used for above-floor cleaning.

Accordingly, it is desirable to develop a new and improved upright vacuum cleaner which would overcome the foregoing deficiencies and others while meeting the above-stated needs and providing better and more advantageous overall results.

SUMMARY OF THE INVENTION

The present invention relates to a new and improved upright vacuum cleaner. More specifically, the upright vacuum cleaner has an above-floor cleaning tool and is used for cleaning carpets, floors, and above-floor surfaces. The vacuum cleaner has a combination brushroll and nozzle inlet control mechanism.

The vacuum cleaner comprises a nozzle base comprising a primary suction opening formed therein, and a suction source which communicates with the primary suction opening. A rotatable brushroll assembly is positioned adjacent the primary suction opening. A dust cup assembly is releasably secured to the nozzle base. The dust cup assembly defines a dirt and dust collecting chamber. The dust cup assembly comprises a first inlet which is in fluid communication with the primary suction opening, and a door which is positioned adjacent the inlet to selectively open and close the inlet. The door comprises a rod which extends therefrom and a finger which protrudes from an end of the rod.

A three position control assembly is located on the nozzle base. The control assembly comprises a selector switch positioned within a slot in the nozzle base and a slide bar connected to the selector switch. Movement of the selector switch to a first and a second position moves the slide bar out of engagement with the finger extending from the door allowing the door to open due to suction air. Movement of the selector switch to a third position moves the slide bar into engagement with the finger to prevent the door from opening due to suction air.

A full-size pulley and an idler pulley are mounted adjacent each other in the nozzle base. A first pulley belt engages a drive shaft of the suction source and one of the full-size pulley and idler pulley. A reduction pulley is connected to the full-size pulley. A second pulley belt engages the reduction pulley and a shaft of the brushroll assembly.

The control assembly further comprises a guide arm assembly connected to the selector switch wherein the guide arm includes a pair of walls forming an opening which selectively receives the first pulley belt. Movement of the selector switch moves the guide arm and the first pulley belt between alignment with the full-size pulley and the idler pulley.

When the selector switch is moved to the first position the slide bar is moved away from the finger of the door thus allowing the door to pivot open when suction air is pulled through the vacuum cleaner. The guide arm aligns the first pulley belt with the full-size pulley, thus rotating the brushroll.

When the selector switch is moved to the second position the slide bar is moved away from the finger of the door, allowing the door to pivot open due to suction air. The guide arm is moved to alignment with the idler pulley, thus preventing rotation of the brushroll.

When the selector switch is moved to the third position the slide bar is moved into contact with the finger of the door, closing the door and preventing suction air from entering the inlet of the dust cup. The guide arm moves into alignment with the idler pulley, thus preventing rotation of the brushroll.

One advantage of the present invention is the provision of a new and improved vacuum cleaner.

Another advantage of the present invention is the provision of an upright vacuum cleaner that eliminates the need for filter bags.

Still another advantage of the present invention is the provision of an upright vacuum cleaner having a low profile nozzle base so that it can fit beneath furniture for effective cleaning.

Yet another advantage of the present invention is the provision of a lightweight upright vacuum cleaner that can be hung for storage.

A further advantage of the present invention is the provision of an upright vacuum cleaner having a removable dust cup located in a nozzle base and having an easy to remove and easy to replace filter assembly.

A yet further advantage of the present invention is the provision of an upright vacuum cleaner having a removable dust cup which has an inlet communicating with a floor nozzle wherein the inlet can be selectively closed.

A still yet further advantage of the present invention is the provision of an upright vacuum cleaner having a three position control assembly in which in a first position a brushroll is driven by a motor while a first inlet to a dust cup is in communication with a floor nozzle; in a second position the brushroll is disconnected from the motor but the first inlet remains open and in a third position the first inlet is closed and the brushroll is prevented from rotation.

Still other benefits and advantages of the invention will become apparent to those skilled in the art upon reading and understanding the following detailed description.

BRIEF DESCRIPTION OF THE DRAWINGS

The invention may take form in certain components and structures, a preferred embodiment of which will be illustrated in the accompanying drawings wherein:

FIG. 8A is a side elevational view of the floor-traveling head of the vacuum cleaner of FIG. 1, partially broken away to illustrate an inlet opening of a dust cup in the open position;

FIG. 8B is a side elevational view of the floor-traveling head of the vacuum cleaner of FIG. 1, partially broken away to illustrate the inlet opening of the dust cup in the closed position; and, FIG. 8C is an enlarged rear elevational view of the inlet opening and door assembly of the dust cup of the vacuum cleaner of FIG. 1.

DETAILED DESCRIPTION OF THE PREFERRED EMBODIMENT

Figure 1:
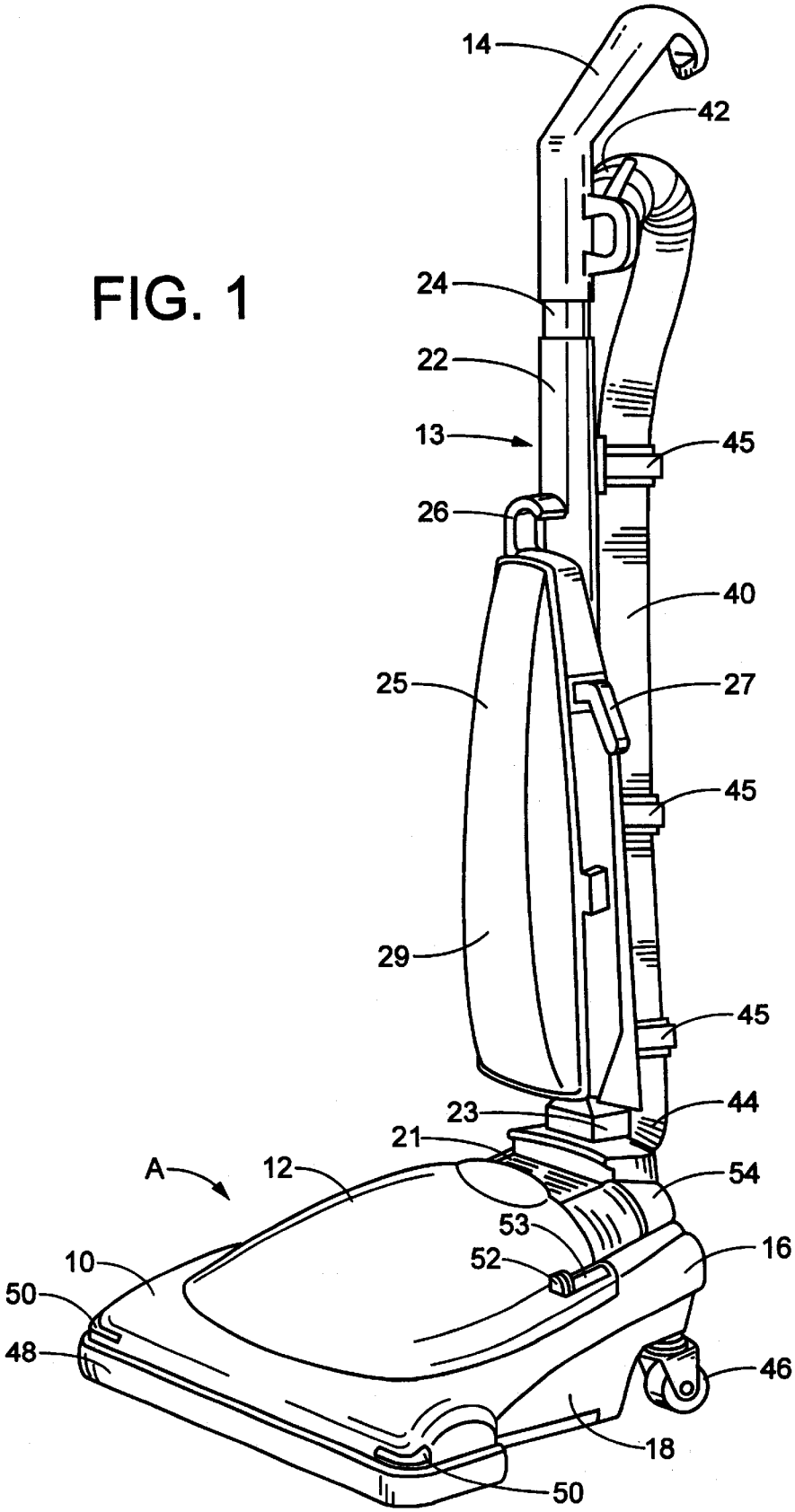
FIG. 1 is a perspective view of the vacuum cleaner according to a preferred embodiment of the present invention.

Referring now to the drawings, wherein the showings are for purposes of illustrating a preferred embodiment of this invention only and not for purposes of limiting same, FIG. 1 shows a vacuum cleaner A according to the preferred embodiment of the present invention. The vacuum cleaner A comprises a floor-traveling head or a nozzle base 10 accommodating a dust cup 12, and a handle assembly 13 pivotally mounted on the floor-traveling head. The handle assembly 13 includes a handle element 14. The floor-traveling head 10 includes a nozzle cover or upper housing 16 and a base or lower housing 18. A motor and fan assembly or suction source 19 (FIG. 5) is positioned within a first cavity (not shown) in the nozzle base. The dust cup 12 is releasably positioned in a second cavity 20 (FIG. 8A) defined in the lower housing 18. The dust cup 12 defines a dirt and dust collecting chamber.

Referring again to FIG. 1, the vacuum cleaner further comprises a motor cover 21 which is positioned over the motor/fan assembly 19 at the rear of the nozzle base. An elongated connecting portion 22, having a first end 23 and a second end 24, is removably attached to the floor-traveling head 10 at its first end. The handle 14 is removably attached to the elongated connecting portion second end 24.

The lower housing member 18 supports the various components of the head. The two housing members 16, 18 are fastened to each other, but do not entirely enclose the motor and fan assembly therebetween. The two housing members 16, 18 thus form part, but not substantially the entirety, of the housing. In addition to these two housing members there is the upper motor housing cover 21, which covers upper portions of the motor and fan assembly. In combination, the three housing members 16, 18, 21 thus form substantially the entirety of the housing for the floor-traveling head 10.

Figure 2:
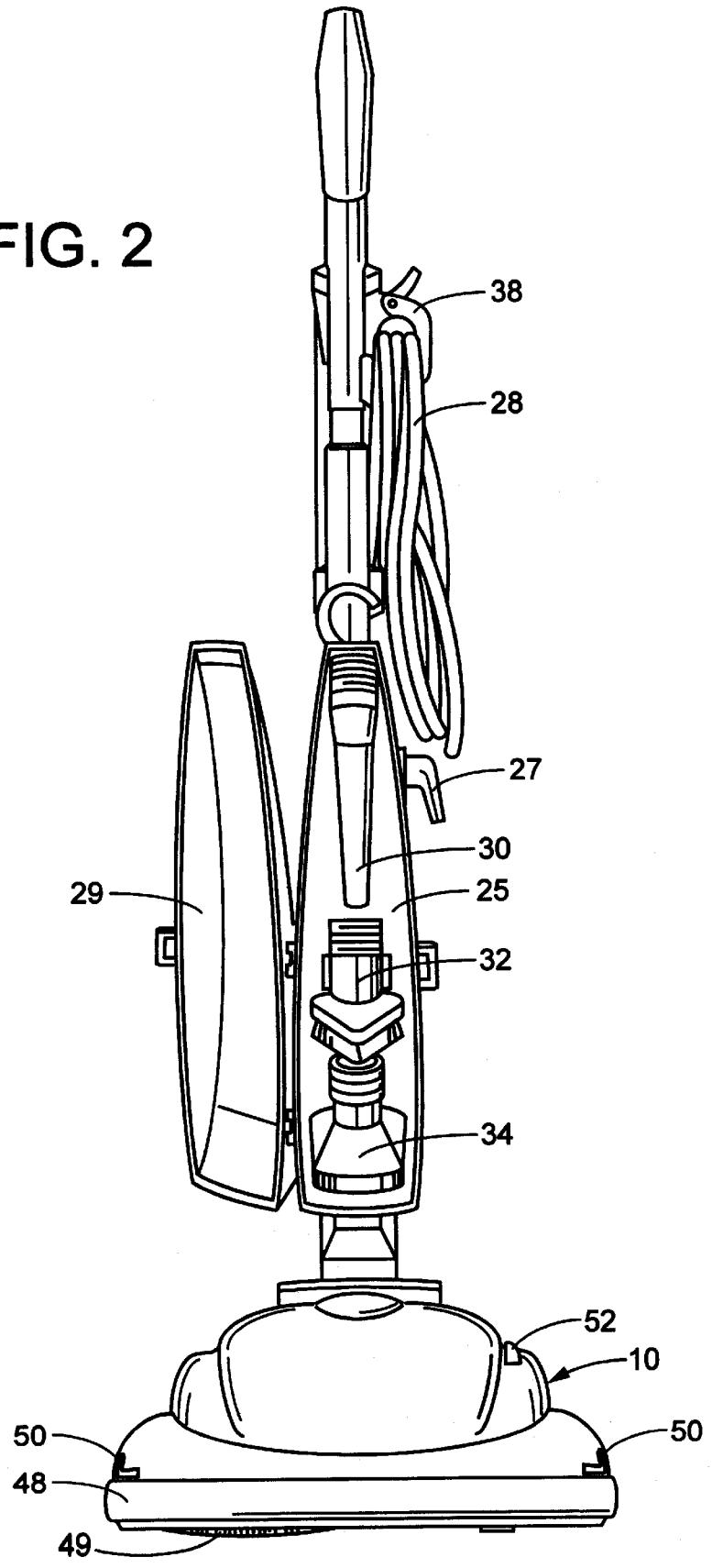
FIG. 2 is an front elevational view of the vacuum cleaner of FIG. 1 showing an opened tool caddy.

A tool caddy 25 is removably mounted to the elongated connecting portion 22. The tool caddy 25 includes a storage hook 26 and an arm 27 which is used to wrap or store a power cord 28 (FIG. 2). The tool caddy 25 can be stored separately via the storage hook 26. The tool caddy 25 houses at least one above-floor cleaning tool. The tool caddy 25 has a door 29 which is opened to allow access to the tools. Referring to FIG. 2, the tools can include a crevice tool 30, a POWER EDGER™ tool 32, and a 2-in-1 dust brush/upholstery tool 34. These tools are used separately in conjunction with the handle 14 to perform above-floor cleaning or corner cleaning.

A quick cord clip 38 is provided on the elongated connecting portion 22 for securing the power cord 28 in a storage position. If desired, the power cord 28 can be wound around an upper portion of the quick cord clip 38 and the arm 27, instead of being looped so as to hang from the cord clip.

The handle 14 can be removed from the elongated connecting portion 22 for use as a handle for an above-floor cleaning tool. A hose 40 is removably attached to the handle 14 at a hose first end 42 and is removably attached to the floor-traveling head 10 at a hose second end 44. Clips 45 secure the hose 40 to the elongated handle portion 22. The hose 40 is used with the above-floor cleaning tools.

Casters 46 and wheels 47 (FIG. 7) extend from beneath the floor-traveling head 10 to facilitate horizontal movement of the vacuum cleaner along a floor surface to be cleaned. At the front of the floor-traveling head 10 is a wraparound bumper 48 which protects the floor-traveling head if the vacuum cleaner bumps into furniture or a wall or other surface. The bumper 48 also protects furniture and walls from being damaged by the vacuum cleaner.

With reference now to FIG. 2, a brushroll 49 extends beneath the floor-traveling head 10. The brushroll 49 is used to agitate the carpet or surface to be cleaned and aids in loosening dirt, dust and other particles for vacuuming into the vacuum cleaner. POWER EDGERM™ tool slots 50 are provided adjacent the wraparound bumper 48.

Figure 3:
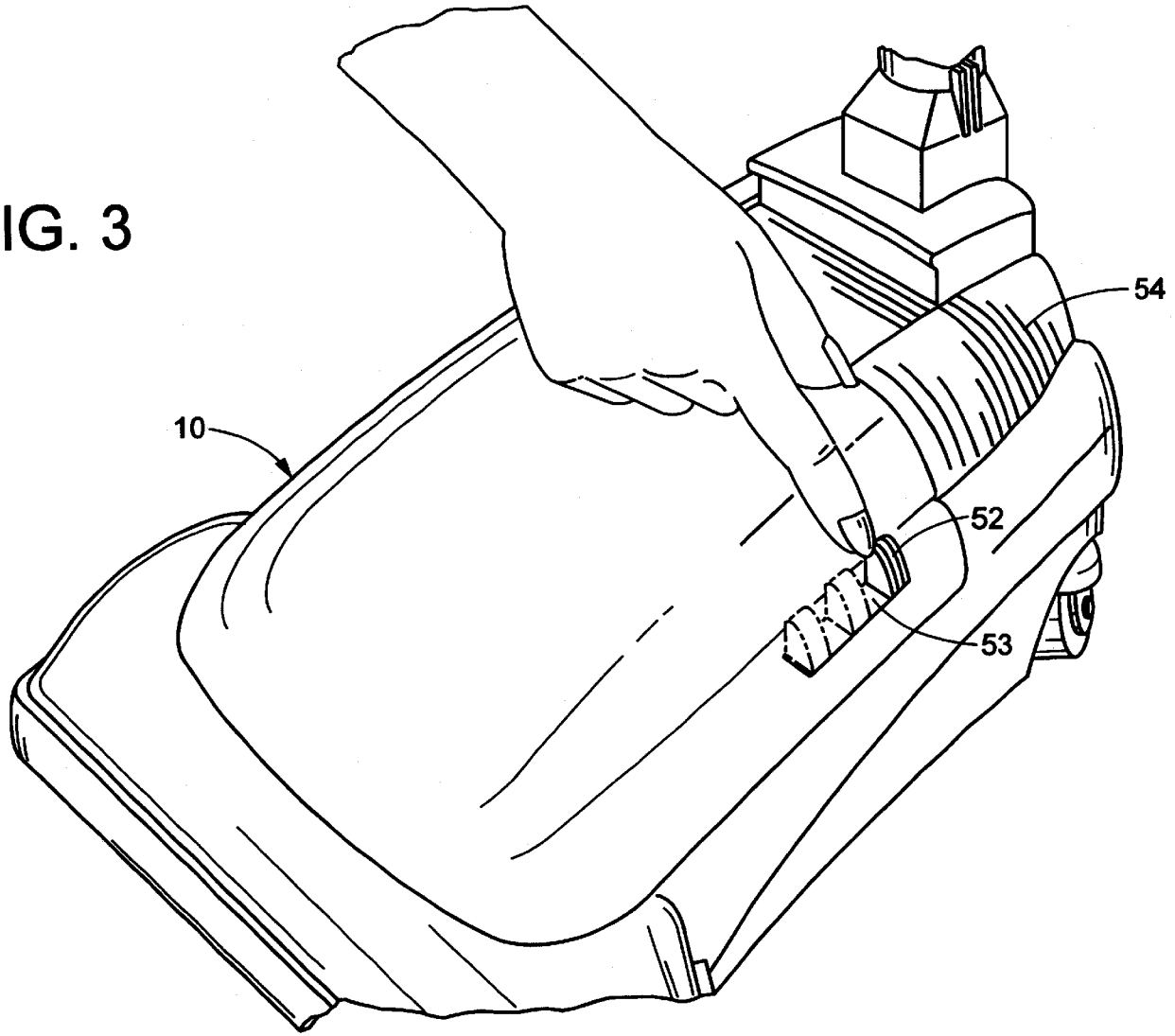
FIG. 3 is an enlarged perspective view of a floor-traveling head of the vacuum cleaner of FIG. 1 illustrating the back position of a control switch.

With reference to FIG. 3, a selector switch 52, protruding through an opening 53 in the upper housing 16, allows switching between a) carpet cleaning, b) bare floor cleaning, and c) above-floor cleaning. When the selector switch 52 is in a back or first position, as shown in solid lines, the vacuum cleaner is ready to sweep carpeted surfaces. In a middle or second position, the vacuum cleaner is ready to sweep bare floors. In a third or forward position, shown in FIG. 1, the vacuum cleaner is ready to clean above-floor surfaces.

Referring again to FIG. 1, an on/off switch 54 is provided at the rear of the nozzle base to activate the motor. A handle release pedal (not shown) is provided to release the handle assembly 13 from its locked upright position on the floor-traveling head 10 so as to allow rearward pivoting of the handle assembly.

Figure 4:
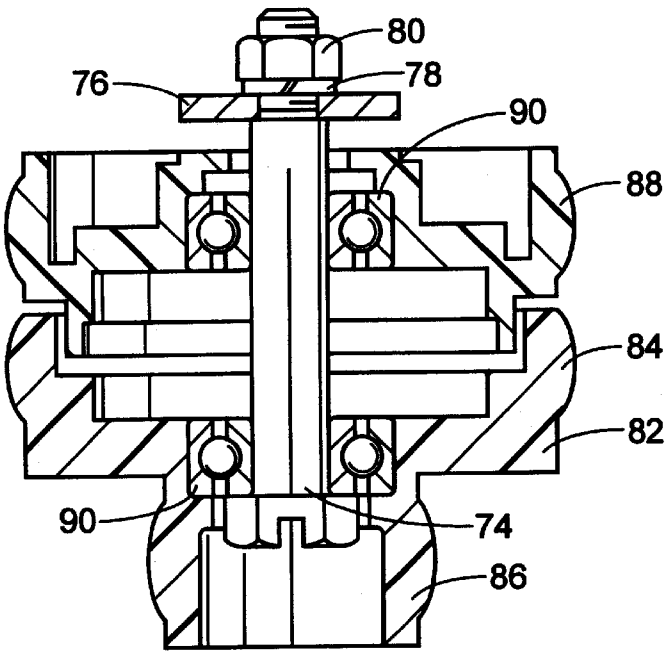
FIG. 4 is a side elevational view in cross-section of a pulley assembly employed with the vacuum cleaner of FIG. 1.

FIG. 4 illustrates a pulley assembly housed within the vacuum cleaner. The pulley assembly includes a common pulley shaft 74 which is mounted on a pulley bracket 76 that is secured to one of the upper housing 16 and the lower housing 18 with a spring washer 78 and nut 80. Rotatably mounted on the pulley shaft is a compound pulley body 82 which includes a full size pulley 84 and a reduction pulley 86. Rotatably mounted adjacent the full size pulley 84 is an idler pulley 88. Respective bearings 90 mount the compound pulley 82 and the idler pulley 88 on the pulley shaft 74.

Figure 5:
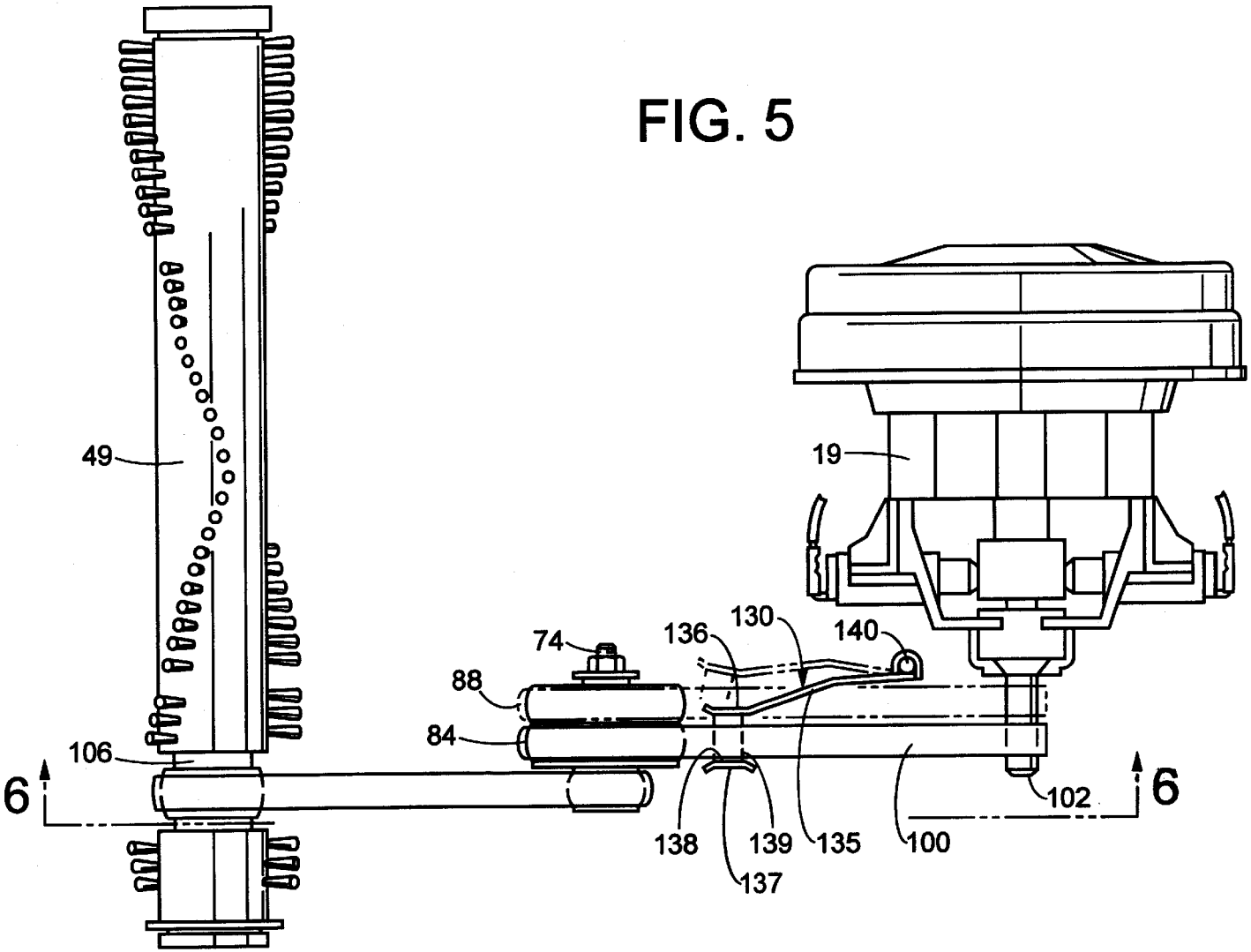
FIG. 5 is a bottom plan view of a brushroll, a pulley assembly and a motor of the vacuum cleaner of FIG. 1.

With reference now to FIG. 5, a first endless belt 100 is looped around either the full size pulley 84 or the idler pulley 88 and a drive shaft 102 of the motor/fan assembly 19. A second endless belt 104 is looped around the reduction pulley 86 and a shaft 106 of the brush roll 49. A control assembly 130 moves the first belt 100 between the full size pulley 84 and the idler pulley 88.

Figure 6:
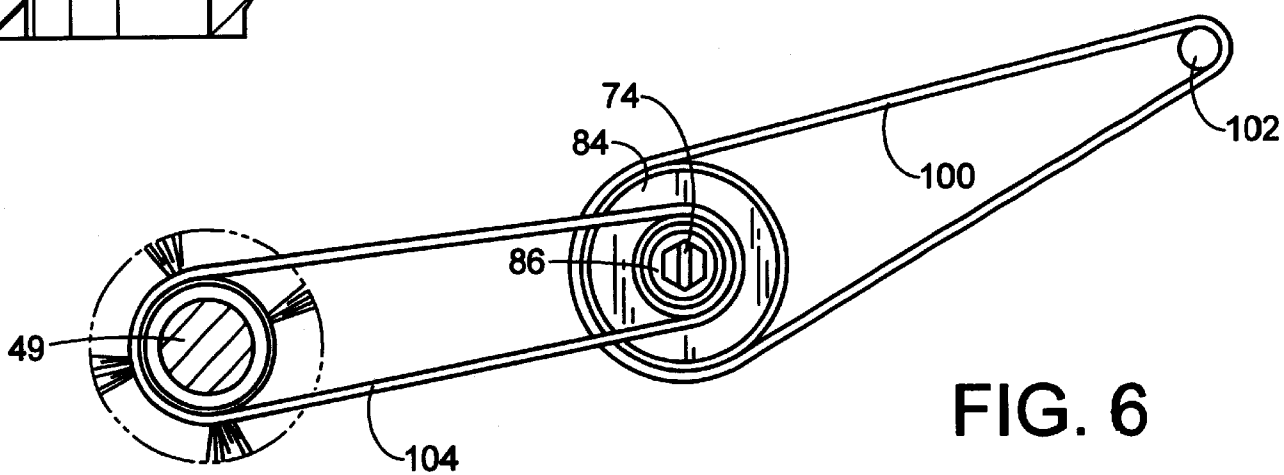
FIG. 6 is a side elevational view, in partial cross-section, of the pulley assembly of FIG. 5 along line 6—6.

FIG. 6 illustrates that the first and second belts 100 and 104 are disposed at an angle in relation to each other since the brushroll 49 is located closer to the ground than is the drive shaft 102.

Figure 7:
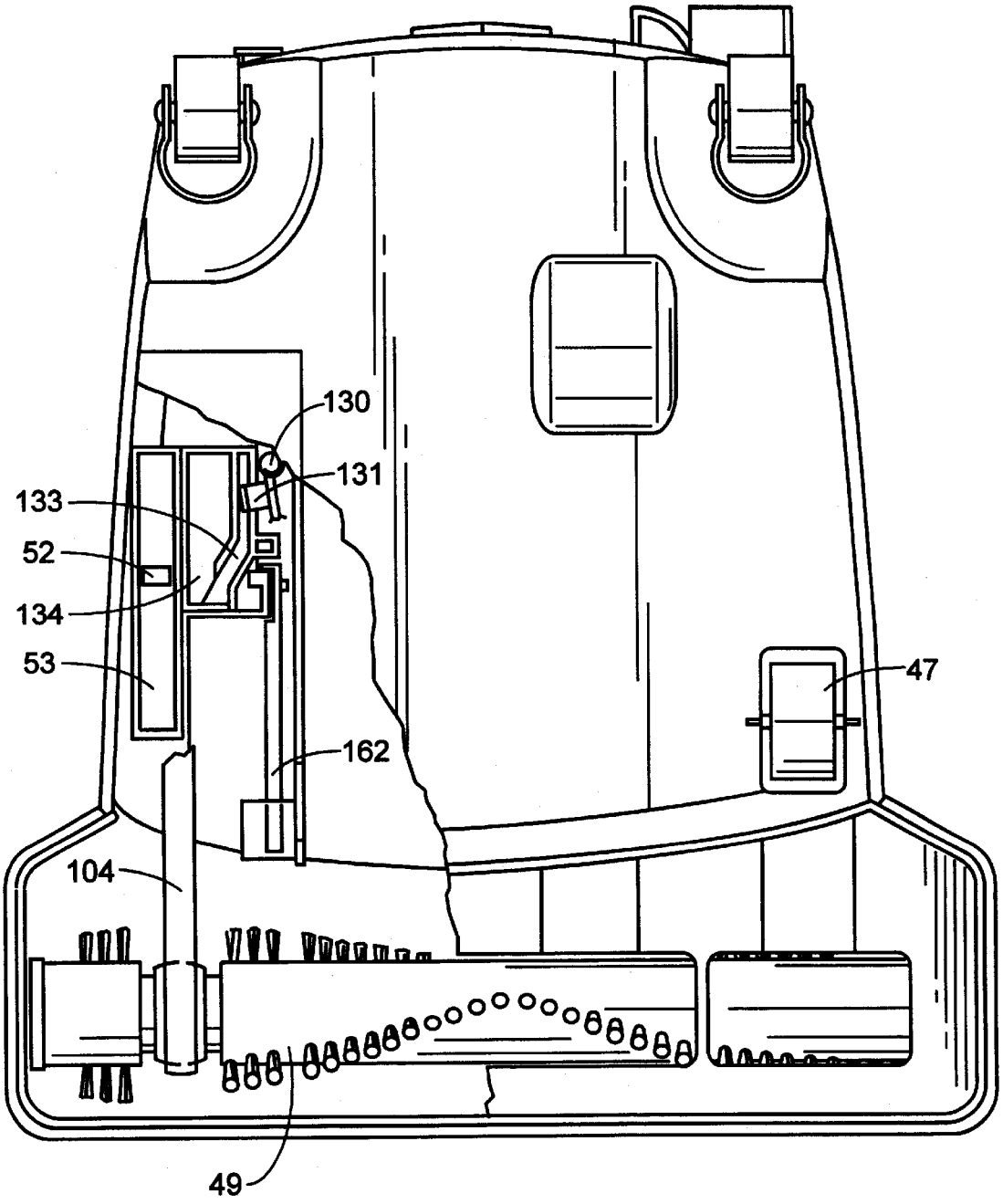
FIG. 7 is an enlarged bottom plan view of a floor-traveling head of the vacuum cleaner of FIG. 1, partially broken away to illustrate the brushroll and pulley assembly.

Referring now to FIG. 7, the selector switch 52 is connected to the control assembly 130 which includes a tab 131 which engages a guide track 133 located within the base of the vacuum. As the selector switch 52 moves from the back position to the front position within the opening 53 in the base, the tab 131 rides within the guide track 133, thus moving a control assembly guide arm 135 (FIG. 5) between alignment with the full size pulley 84 and the idler pulley 88. The guide track 133 has an angled portion 134 to allow the guide arm 135 to move between alignment with either the full-size pulley 84 or the idler pulley 88. The angled portion 134 is used for pivoting the guide arm 135 between the back position to the middle position. As the guide arm 135 moves from the middle position to the first position, the guide arm 135 does not pivot and remains in the same position. Referring to FIG. 5, the guide arm 135 includes a pair of lateral walls 136, 137 spaced from and approximately parallel to each other and connected to each other via a base wall 138. The three walls 136, 137, 138 form a slot or opening 139 between them. The guide arm 135 is angled so that the slot 139 may be aligned along a longitudinal axis of full-size pulley 84 or idler pulley 88. The first belt 100 is positioned within the slot 139. As the guide arm 135 moves, it pivots about a pivot point 140. During such movement, the first belt 100 is moved between engagement with the idler pulley 88 and the full size pulley 84. In FIG. 5, the first belt 100 is shown engaging the full-size pulley 84.

For carpet cleaning, the selector switch 52 is moved to a back position shown in FIG. 3. In the back position, the brushroll 49 is rotated. As shown in FIG. 5, when the selector switch 52 is in the back position, the guide arm 135 is shifted to align with the full-size pulley 84. The first belt 100 is then also shifted to engage the full size pulley 84. Since the reduction pulley 86 is connected to the pulley 84, when the motor 19 is operated, the first belt 100 rotates due to the drive shaft 102 of the motor 19, rotating both the full-size pulley 84 and the reduction pulley 86. Second belt 104 connects the shaft 106 of brushroll 49 to the reduction pulley 86, thus, brushroll 49 is also rotated when the motor 19 is operated.

Referring to FIGS. 8A–8C, the dust cup 12 includes an inlet opening 142 which is in fluid communication with a primary suction opening 144 which is adjacent the brushroll 49. The primary suction opening 144 is also in communication with the motor 19 through the dust cup 12. Referring to FIG. 8C, the dust cup includes a door 146, and a finger 148 which extends from the door on a rod 150. The rod 150 is mounted in openings in two guide arms 152, 154 which are formed in a front wall 156 of the dust cup 12 above the inlet opening 142. A spring 160 is mounted onto the rod 150 and biases the door 146 to a closed position. The door 146 rotates about a pivot point 161.

As shown in FIG. 7 and FIGS. 8A and 8B, the control mechanism further includes a slide bar 162 which is connected to the selector switch 52. When the selector switch 52 is in the back position, the slide bar 162 is moved away from the finger 148, thus allowing the door 146 to be swung open about pivot point 161 due to suction air being pulled through the primary suction opening 144 into the inlet 142 of the dust cup 12. The difference in air pressure between the inside of the dust cup and outside the vacuum cleaner opens the door by overcoming the force of the spring 160. Thus, for carpet cleaning, the inlet 142 of the dust cup receives suction air and the brushroll 49 is rotated.

When the selector switch 52 is in the middle position, the guide arm 135 is moved to the position shown in dashed lines in FIG. 5, where the guide arm is aligned with the idler pulley 88. The first belt 100 then engages the idler pulley 88. The full size pulley 84 is not engaged by the belt 100, and as a result does not rotate, thus preventing the reduction pulley 86 and the brushroll 49 from also rotating. The slide bar 162 is still moved away from contact with the finger 148, thus allowing the door 146 to be pivoted open by suction air. In this position, the vacuum cleaner may be used for hard surface floor cleaning, such as wood floors or vinyl floors.

Since brushroll 49 does not rotate, it will not potentially damage the floors.

When the selector switch 52 is moved to the forward position, as shown in FIG. 8B, the slide bar 162 engages a protrusion 168 on the finger 148 and pushes the door 146 into its spring biased closed position. Thus, no suction air passes through the inlet 142 into the dust cup 12. This allows above-floor cleaning tools to be used and for all of the suction to be applied to above-floor cleaning. In moving from the middle position to the forward position, the guide arm 135 remains in the position shown in dashed lines in FIG. 5, where the guide arm is aligned with the idler pulley 88. The first belt 100 remains shifted to and engaging the idler pulley 88. The full size pulley 84 is not engaged by the belt 100, and as a result does not rotate, thus preventing the reduction pulley 86 and brushroll 49 from also rotating. Again, since above-floor cleaning tools are being used, there is no need for rotation of the brushroll 49.

The invention has been described with reference to a preferred embodiment. Obviously, alterations and modifications will occur to others upon a reading and understanding of this specification. It is intended to include all such modifications and alterations insofar as they come within the scope of the appended claims or the equivalents thereof.

What is claimed is:

1. A vacuum cleaner comprising:

a nozzle base comprising a primary suction opening formed therein;

a suction source communicating with said primary suction opening;

a dust cup assembly releasably secured to said nozzle base, said dust cup assembly defining a dirt and dust collecting chamber, said dust cup assembly comprising:

an inlet, said inlet being in fluid communication with said primary suction opening, and a door positioned adjacent said inlet to selectively open and close said inlet; and a three position control assembly located on said nozzle base wherein in a first position said door is opened by suction air entering said primary suction opening and said inlet, in a second position, said door remains open as suction air enters said primary suction opening and said inlet, and in a third position, said door is closed.

2. The vacuum cleaner of claim 1 further comprising a rotatable brushroll assembly positioned adjacent said primary suction opening.

3. The vacuum cleaner of claim 1 wherein said door comprises a rod extending therefrom and a finger which protrudes from an end of said rod.

4. The vacuum cleaner of claim 3 wherein said control assembly comprises a selector switch positioned within a slot in said nozzle base and a slide bar connected to said selector switch, wherein movement of said selector switch to the first and second positions moves said slide bar out of engagement with said finger extending from said door allowing said door to open due to suction air; and wherein movement of said selector switch to said third position moves said slide bar into engagement with said finger to prevent said door from opening due to suction air.

5. The vacuum cleaner of claim 1 further comprising a full-size pulley and an idler pulley which are mounted adjacent each other in said nozzle base.

6. The vacuum cleaner of claim 5 further comprising a first pulley belt, said first pulley belt engages a drive shaft of said suction source and one of said full-size pulley and idler pulley.

7. The vacuum cleaner of claim 6 further comprising a reduction pulley, said reduction pulley being connected to said full-size pulley.

8. The vacuum cleaner of claim 7 further comprising a second pulley belt which engages said reduction pulley and a shaft of said brushroll assembly.

9. The vacuum cleaner of claim 8 wherein said control assembly further comprises a guide arm assembly connected to said selector switch wherein said guide arm includes a pair of walls forming an opening which selectively receives said first pulley belt, wherein said first pulley belt engages one of said idler pulley and said full-size pulley, wherein movement of said selector switch moves said guide arm and said first pulley belt between alignment with said full-size pulley and said idler pulley.

10. A vacuum cleaner comprising:

a nozzle base comprising at least one suction opening;

a suction source communicating with the primary suction opening;

a dust cup assembly releasably secured to said nozzle base, said dust cup assembly defining a dirt and dust collecting chamber, said dust cup assembly comprising:

an inlet in fluid communication with at least one suction opening, and a door positioned adjacent said inlet to selectively open and close said inlet, said door comprising a rod extending therefrom and a finger which protrudes from an end of said rod; and a manual control assembly mounted on said nozzle base, said manual control assembly comprising:

a selector switch positioned within a slot in said nozzle base, and a slide bar connected to said selector switch, wherein said slide bar, in one position thereof, engages said finger extending from said door to prevent said door from opening due to suction air.

11. The vacuum cleaner of claim 10 further comprising a full-size pulley and an idler pulley which are mounted adjacent each other in said nozzle base.

12. The vacuum cleaner of claim 11 further comprising a first pulley belt, said first pulley belt engaging one of said full-size pulley and idler pulley.

13. The vacuum cleaner of claim 12 wherein said manual control assembly further comprises a guide arm assembly connected to said selector switch, said guide arm assembly including a pair of walls forming an opening which receives said first pulley belt, wherein said first pulley belt engages one of said idler pulley and said full-size pulley.

14. The vacuum cleaner of claim 13 further comprising a reduction pulley, said reduction pulley being connected to said full-size pulley, and a second pulley belt which engages said reduction pulley and said shaft of said brushroll assembly.

15. The vacuum cleaner of claim 14 wherein when said selector switch is moved to a first position, said slide bar is moved away from said finger of said door thus allowing said door to pivot open when suction air is pulled through said vacuum cleaner, and wherein said guide arm aligns said first pulley belt with said full-size pulley, rotating said brushroll.

16. The vacuum cleaner of claim 14 wherein when said selector switch is moved to a second position, said slide bar is moved away from said finger of said door, allowing said door to pivot open due to suction air, and wherein said guide arm is moved to alignment with said idler pulley, thus preventing rotation of said brushroll.

17. The vacuum cleaner of claim 14 wherein when said selector switch is moved to a third position, said slide bar is moved into contact with said finger of said door, preventing suction air from entering said inlet of said dust cup, and wherein said guide arm moves into alignment with said idler pulley, thus preventing rotation of said brushroll.

18. A vacuum cleaner comprising:

a nozzle base comprising a primary suction opening formed therein;

a suction source communicating with said primary suction opening;

a dust cup assembly releasably positioned in a cavity defined in said nozzle base, said dust cup assembly defining a dirt and dust collecting chamber, said dust cup assembly comprising:

an inlet, said inlet being in fluid communication with said primary suction opening, and a door positioned adjacent said inlet to selectively open and close said inlet, said door comprises a rod extending therefrom and a finger which protrudes from an end of said rod;

a rotatable brushroll assembly positioned adjacent said primary suction opening, said brushroll including a shaft;

at least two pulleys mounted in said nozzle base;

a first pulley belt which engages one of said pulleys and a drive shaft of said suction source, a second pulley belt which engages another of said at least two pulleys and said shaft of said brushroll;

a manual control assembly mounted on said nozzle base, said manual control assembly comprising:

a selector switch positioned within a slot in said nozzle base;

a guide arm assembly connected to said selector switch, said guide arm including a pair of walls forming an opening which receives said pulley belt;

wherein movement of said selector switch moves said guide arm and said first pulley belt between alignment with one of said at least two pulleys and another of said at least two pulleys.

19. The vacuum cleaner of claim 18 wherein said at least two pulleys comprise a full-size pulley and an idler pulley which are mounted adjacent each other in said nozzle base and a reduction pulley connected to said full-size pulley.

20. The vacuum cleaner of claim 19 wherein said first pulley belt engages one of said full-size pulley and idler pulley.

21. The vacuum cleaner of claim 19 wherein said second pulley belt engages said reduction pulley.

22. The vacuum cleaner of claim 18 wherein said manual control assembly further comprises a slide bar connected to said selector switch, wherein said slide bar engages said finger extending from said door to prevent said door from opening due to suction air.

23. The vacuum cleaner of claim 22 wherein when said selector switch is moved to a first position, said slide bar is moved away from said finger of said door thus allowing said door to pivot open when suction air is pulled through said vacuum cleaner, and wherein said guide arm aligns said first pulley belt with said full-size pulley, rotating said brushroll.

24. The vacuum cleaner of claim 22 wherein when said selector switch is moved to a second position, said slide bar is moved away from said finger of said door, allowing said door to pivot open due to suction air, and wherein said guide arm is moved to alignment with said idler pulley, thus preventing rotation of said brushroll.

25. The vacuum cleaner of claim 22 wherein when said selector switch is moved to a third position, said slide bar is moved into contact with said finger of said door, preventing suction air from entering said inlet of said dust cup, and wherein said guide arm moves into alignment with said idler pulley, thus preventing rotation of said brushroll.

* * * * *